US011708238B2

(12) United States Patent
Hiltunen et al.

(10) Patent No.: US 11,708,238 B2
(45) Date of Patent: Jul. 25, 2023

(54) ARRANGEMENT FOR THE ALLOCATION OF DESTINATION CALLS

(71) Applicant: KONE Corporation, Helsinki (FI)

(72) Inventors: Jussi Hiltunen, Helsinki (FI); Kim Bergman, Helsinki (FI)

(73) Assignee: KONE Corporation, Helsinki (FI)

( * ) Notice: Subject to any disclaimer, the term of this patent is extended or adjusted under 35 U.S.C. 154(b) by 1307 days.

(21) Appl. No.: 15/719,103

(22) Filed: Sep. 28, 2017

(65) Prior Publication Data

US 2018/0016116 A1 Jan. 18, 2018

Related U.S. Application Data

(63) Continuation of application No. PCT/EP2015/058448, filed on Apr. 17, 2015.

(51) Int. Cl.
*B66B 3/00* (2006.01)
*B66B 1/46* (2006.01)
(Continued)

(52) U.S. Cl.
CPC ..... *B66B 1/468* (2013.01); *B66B 3/002* (2013.01); *B66B 5/0018* (2013.01);
(Continued)

(58) Field of Classification Search
CPC ..... B66B 2201/101; B66B 2201/103; B66B 2201/104; B66B 2201/4638; B66B 2201/4653; B66B 1/3461
(Continued)

(56) References Cited

U.S. PATENT DOCUMENTS 10,597,255 B2 * 3/2020 Chapman ..... B66B 1/2408
2012/0168262 A1 * 7/2012 Finschi ..... B66B 1/467 187/392

(Continued)

FOREIGN PATENT DOCUMENTS

JP 2003-040535 A 2/2003
JP 2009-298507 A 12/2009
JP 2014-084219 A 5/2014

*Primary Examiner* — Christopher Uhlir
(74) *Attorney, Agent, or Firm* — Birch, Stewart, Kolasch & Birch, LLP

(57) ABSTRACT

The invention refers to an arrangement for the allocation of destination calls in an elevator system with at least two elevators, comprising a wireless transmitter device connected with an allocation control of the elevator system. The transmitter device interacts within a certain mutual distance with a wireless ID device carried by a passenger, which ID device is configured to transmit to the transmitter device an ID which is linked with a special transportation service in the elevator system. The elevator system comprises a memory with correlated operation parameters of the elevators which are linked to the particular special transportation service request of the ID device, whereby the ID device is configured to transmit ID data and/or a call with a departure floor and destination floor to the allocation control. The transmitter device is located within a transmitter accommodation space located at least in the vicinity of an elevator, whereby the transmitter device is located in the vicinity of a tag carrying a symbol correlated to the special transportation service.

17 Claims, 2 Drawing Sheets

(51) Int. Cl.
*B66B 1/34* (2006.01)
*B66B 5/00* (2006.01)

(52) U.S. Cl.
CPC . *B66B 2201/103* (2013.01); *B66B 2201/4615* (2013.01); *B66B 2201/4638* (2013.01); *B66B 2201/4653* (2013.01); *B66B 2201/4661* (2013.01)

(58) Field of Classification Search
USPC ..... 187/247
See application file for complete search history.

(56) References Cited

U.S. PATENT DOCUMENTS

2012/0223865 A1* 9/2012 Li ..... H01Q 1/243 343/702
2012/0305340 A1* 12/2012 Wu ..... B66B 5/0012 187/380

* cited by examiner

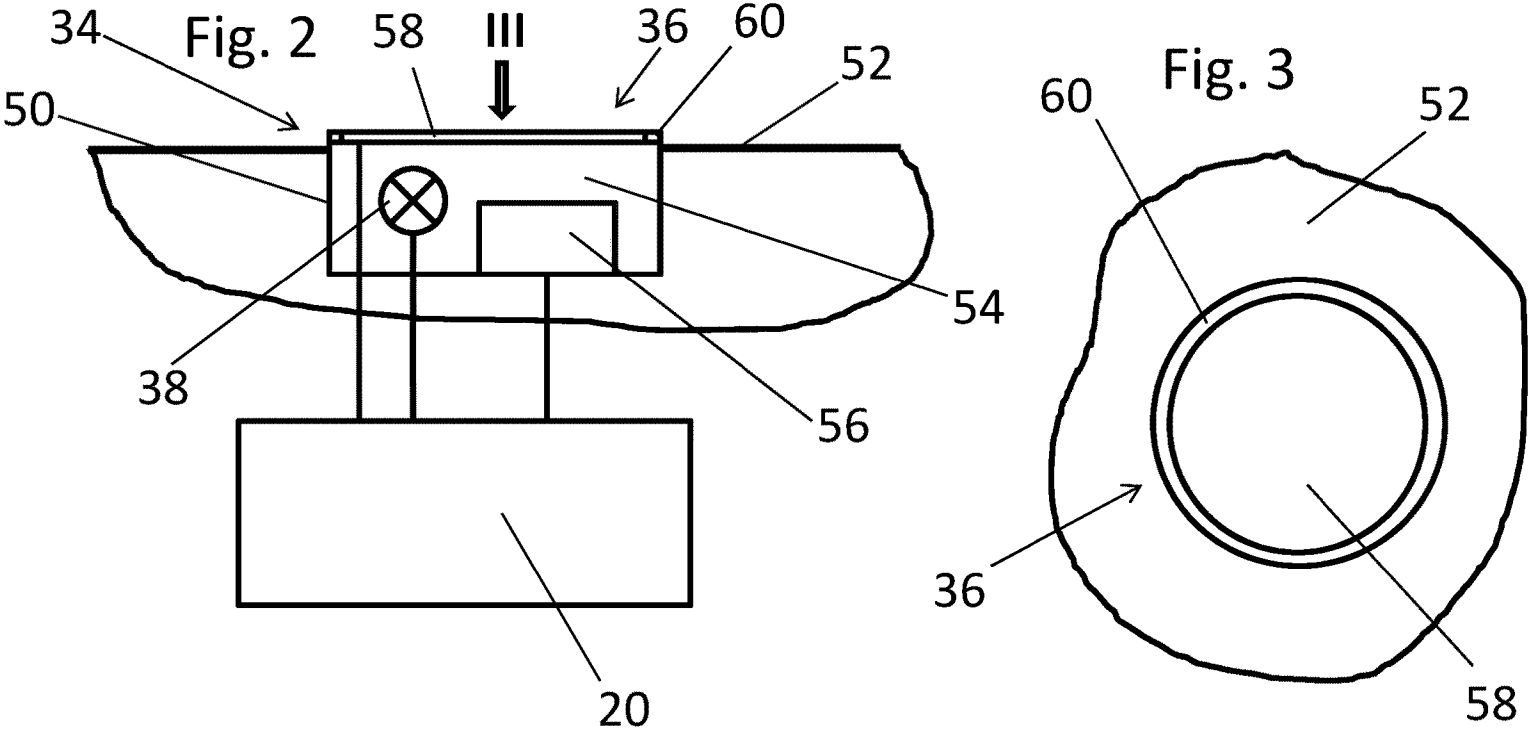
Fig. 2
Fig. 3
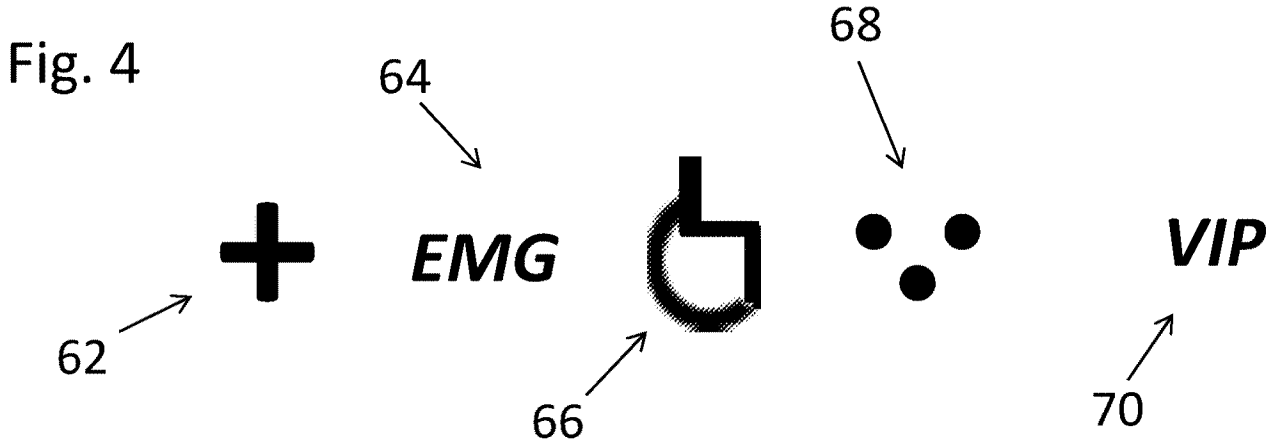
Fig. 4

ARRANGEMENT FOR THE ALLOCATION OF DESTINATION CALLS

CROSS REFERENCE TO RELATED APPLICATIONS

This application is a Continuation of PCT International Application No. PCT/EP2015/058448, filed on Apr. 17, 2015, which is hereby expressly incorporated by reference into the present application.

BACKGROUND OF THE INVENTION

The present invention relates to an arrangement for the allocation of destination calls in an elevator system. The arrangement comprises a wireless transmitter device connected with an allocation control of the elevator system. The allocation control may be a separate module which is responsible for the car allocation in the elevator system or it may be part of an elevator control, possibly integrated with it. The transmitter interacts within a certain mutual distance with a wireless ID device carried by a passenger. This means that the ID device carried by the passenger interacts with the transmitter device only in a certain range, e.g. some meters, e.g. 5 to 20 m maximally. Such a short range wireless transmission system could be for example based on Bluetooth® transmission but also on any other short range broadcast system. Although not preferred, also optical transmission means as IR or sound transmission as e.g. ultrasound is possible. According to the invention, the ID device is linked with a special transportation service in the elevator system. This ID device is therefore given for example VIP persons or handicapped persons which require a certain service in the elevator system which deviates from normal operation. The ID device is configured to transmit the ID data and/or a call with a departure floor and a destination floor to the allocation control. Principally, the transmission of the ID data is enough to enable the elevator control or allocation control to retrieve all necessary call data related to the ID transmitted by the ID device, e.g. stored in a memory. Further, via the ID data also information on a special transportation service as for example emergency service, VIP service, handicapped service as for example wheelchair service, blind persons service, is transferred to the elevator system. On this behalf the elevator control may have a stored table with IDs of ID devices, with corresponding default departure floors and destination floors as well as with a characterization of the specialized transportation service type.

SUMMARY OF THE INVENTION

It is object of the present invention to offer an arrangement of the above mentioned type which allows an elevator system to easily meet special transportation service requirements without requiring manual interaction of the corresponding passenger with the elevator system.

The object of the invention is solved with an arrangement according to claim 1 as well as with a method according to claim 16. Preferred embodiments of the invention are subject-matter of the corresponding dependent claims. The invention is also described in the description as well as in the drawings. The inventive content of the application may also consist of several separate inventions, especially if the invention is considered in the light of expressions or implicit subtasks or from the point of view of advantages achieved.

In this case, some of the attributes contained in the claims below may be superfluous from the point of view of separate inventive concepts.

According to the invention, the transmitter device is located at least in the vicinity of the elevator system, for example near an elevator, particularly in the elevator lobby, but also in an elevator car. The transmitter device is thereby located in the vicinity of a tag carrying a symbol correlated to a special transportation service. Via this measure, a person requiring a special transportation system immediately recognizes that on one hand the required special transportation system is provided by the elevator. Further, he acknowledges the location of the transmitter device with which his ID device is going to interact to initiate an elevator call implementing the special transportation service according to his ID. Particularly, the IL) device is a transponder, for example RFID device which is energized and started when getting in the vicinity of the transmitter device located in the vicinity of the tag. Thereby, the call with the special transportation service is automatically issued without any necessity of manual interaction of the passenger. The elevator system receives the call and automatically the elevator control/allocation control sets the operating parameters of the elevator system to meet the special transportation service. One possibility of a special transportation service is for example a transportation service for a wheelchaired person. In this case, the operation parameters of the elevator system comprise longer door opening times, a longer delay between the issue of the call and the arrival of the allocated elevator, possibly reduced acceleration values for the elevator car. If elevator cars with different sizes are provided in the elevator system, then the wheelchaired person call can be allocated only to more voluminous elevator cars. Further, the elevator system may consider the load status of the elevator cars of the elevator system for the allocation of the special transportation service. Accordingly, the invention provides easy handling of calls requiring a special transportation service. Of course, the different special transportation services as wheelchaired person transport, blind person transport, VIP transport, emergency transport, first aid transport, etc. require different elevator parameters so that preferably in a memory of the elevator control for each of these different special transportation services an own set of operation parameters is stored. Thus, the elevator control is able to adapt the operating parameters of the elevators in the elevator system to the different special transportation services as outlined above.

In a preferred embodiment of the invention, the tag is covering the transmitter accommodation space, which means that the transmitter device is located directly behind the tag. In this case, the passenger carrying the ID device is immediately able to locate the exact position of the transmitter device to interact with his ID device.

Preferably, in this case the tag is made of a material permeable for the emitted broadcast signals of the transmitter device and the ID device. Via this measure it is ensured that the broadcast signals are not too much attenuated by the tag covering the transmitter accommodation space.

Preferably, at least a part of the tag is illuminated by an illumination device and the illumination device is operable by the elevator system when the transmitter receives data from the ID device and/or a call is allocated in response to the interaction between the transmitter and the ID device. Via this measure, the person carrying the ID device is able to see via the illumination of the tag that a call with a special transportation service request has been issued by the interaction of his ID device with the transmitter device. The illumination is therefore a confirmation for the passenger to see that his special transportation service request has been acknowledged by the elevator system. Preferably, the tag may comprise light permeable parts so that the illumination can be seen when the illumination device is arranged behind the tag.

In a preferred embodiment of the invention, an audio device is located in the vicinity of the tag, which audio device is operable by the allocation control when the transmitter receives data from the ID device and/or a call is allocated in response to the interaction between the transmitter and the ID device. Via this means, the confirmation or acknowledgement of a special transportation service request via the ID device can be confirmed to the passenger also in cases where the passenger isn't able to acknowledge a visual confirmation of the call, for example via the illumination of the tag. This measure is particularly preferable for the transportation of blind passengers.

In a preferred embodiment of the invention, the ID device is a smartphone on which an application (App) is running whereby the ID device comprises default transmission data which is correlated with a predetermined departure floor and destination floor. Via this means, a default call which is for example correlated with a predetermined destination of the corresponding passenger can be given without any manual interaction of the passenger.

Preferably, the ID device is a smartphone on which an application is running whereby the ID device allows the input of a destination floor which is transmitted together with a predetermined or actual departure floor to the transmitter device. Via this means, the passenger is not fixed to a predetermined destination floor but he has the option to manually input a different destination floor deviating from the default values.

In a preferred embodiment of the invention, the symbol on the tag comprises visual elements and/or three-dimensional touchable elements. Via this measure, the symbol of the tag regarding a certain special transportation service can immediately recognized either visually or by touching it which is relevant for example for blind persons.

In a preferred embodiment of the invention, the tag is realized as a display which is configured to display different symbols according to different special transportation services in response to the data received from the ID device. Thus, the elevator system can for example offer special transportation services for different kind of special passengers, for example for wheelchaired persons, for blind persons, for VIPs, for first aid use, etc. The person carries an ID device having ID data which is linked to one of these different special transportation services. After receipt of the data from the ID device via the transmitter device, the display is controlled by the elevator control and/or allocation control to display the symbol related to said certain special transportation service which is correlated to the ID device of the passenger getting into interaction with the transmitter device. Thus, one tag is able to display different kinds of special transportation services. Such a display can for example be an LCD display or an LED display or TFT display or other per se known displays.

Of course, the invention also relates to an elevator system comprising at least one arrangement of the above-mentioned type. Preferably, the allocation control or elevator control of the elevator system is configured to change the operation parameters of an elevator in response to a call entered by the interaction between the ID device and the transmission device. Thus, the transportation service of the elevator system can be adapted to the special transportation service request of the passenger carrying the ID device.

Preferably, the operation parameters comprise at least one of the following parameters: door opening time, door velocity, car acceleration, car speed, time span between the allocation of an elevator car and the arrival of the allocated elevator car at the departure floor, car size, car load status, allocation principles (e.g. direct drive to destination floor without intermediate stop). Via this measure, the elevator system is able to adapt the transportation acceleration and/or velocity to the special transportation request. On the other hand, the elevator system is able to consider the car size (if cars of different size are available in the elevator system) or the car load status for the allocation of the car in response to the interaction between the ID device and the transmitter device. The car load status may be relevant to enable a wheelchaired person to enter a comparably empty car, which may be not possible if the car is too crowded. For emergency calls, the velocity and acceleration can thus be increased whereas for sensible or handicapped passengers the acceleration and velocity of the elevator can be decreased. The operating parameters may of course also be allocation parameters of an allocation control algorithm of the allocation control 20, as e.g. riding time, waiting time, number of allowed intermediate stops etc.

Preferably, the allocation control comprises an indication device for the allocated elevator. The indication device can thus be for example a destination operation panel of the elevator system or the smartphone or ID device of the passenger, which of course requires a display.

In a preferred embodiment of the invention, a tag is located at each elevator of the elevator system and the indication device is arranged in connection with or in the vicinity of each tag, e.g. realized by the tag. Thus, the illumination of a tag of one elevator shows that the special transportation request has been allocated to the elevator where the tag is illuminated.

The invention also relates to a method for allocating destination calls wirelessly in an elevator system in connection with a special transportation service of the elevator. Hereby, a call requiring a special transportation service is issued by an ID device wirelessly via interaction with a transmission device located in the vicinity of a tag carrying a symbol indicative of the special transportation service. Via this method, a passenger requiring a special transportation service immediately acknowledges the point of interaction with his ID device and on the other hand acknowledges that the elevator system is able to meet his special transportation service request. Preferably, the tag is also used as an indication device for the allocated elevator if each elevator is provided with a tag in the elevator lobby.

Preferably, the tag is illuminated in response to the interaction between the ID device and the transmission device so that the passenger gets a confirmation of his special transportation service request.

Preferably, the method is executed in an elevator system as described above

It shall be clear for the skilled person that one or more of the above-mentioned components can be provided as a single unit or as several distributed units. Furthermore, it is clear for the skilled person that different components of the invention can be provided separately or integrated with each other. Thus, the allocation control of the elevator can for example be established as a separate module which is located together with the elevator control or separated therefrom or it can be integrated as a functional module in the elevator control. The elevator system comprises at least two elevators whereby the elevator system can be an elevator group or an elevator system with multiple groups for example in high-rise buildings where different zones with different groups are provided. In this case the interaction between the ID device and the transmitter device may initiate a call in several of these groups, preferably with a certain delay considering the riding time in the groups before.

BRIEF DESCRIPTION OF THE DRAWINGS

The invention is described in detail via an example in the enclosed schematic drawing.

FIG. 2 shows a schematic sectional view of a transmitter device and a tag which comprises a display for displaying different symbols, FIG. 3 is a view III of FIG. 2 and FIG. 4 shows different symbols for different special transportation services.

DESCRIPTION OF THE PREFERRED EMBODIMENTS

Figure 1:
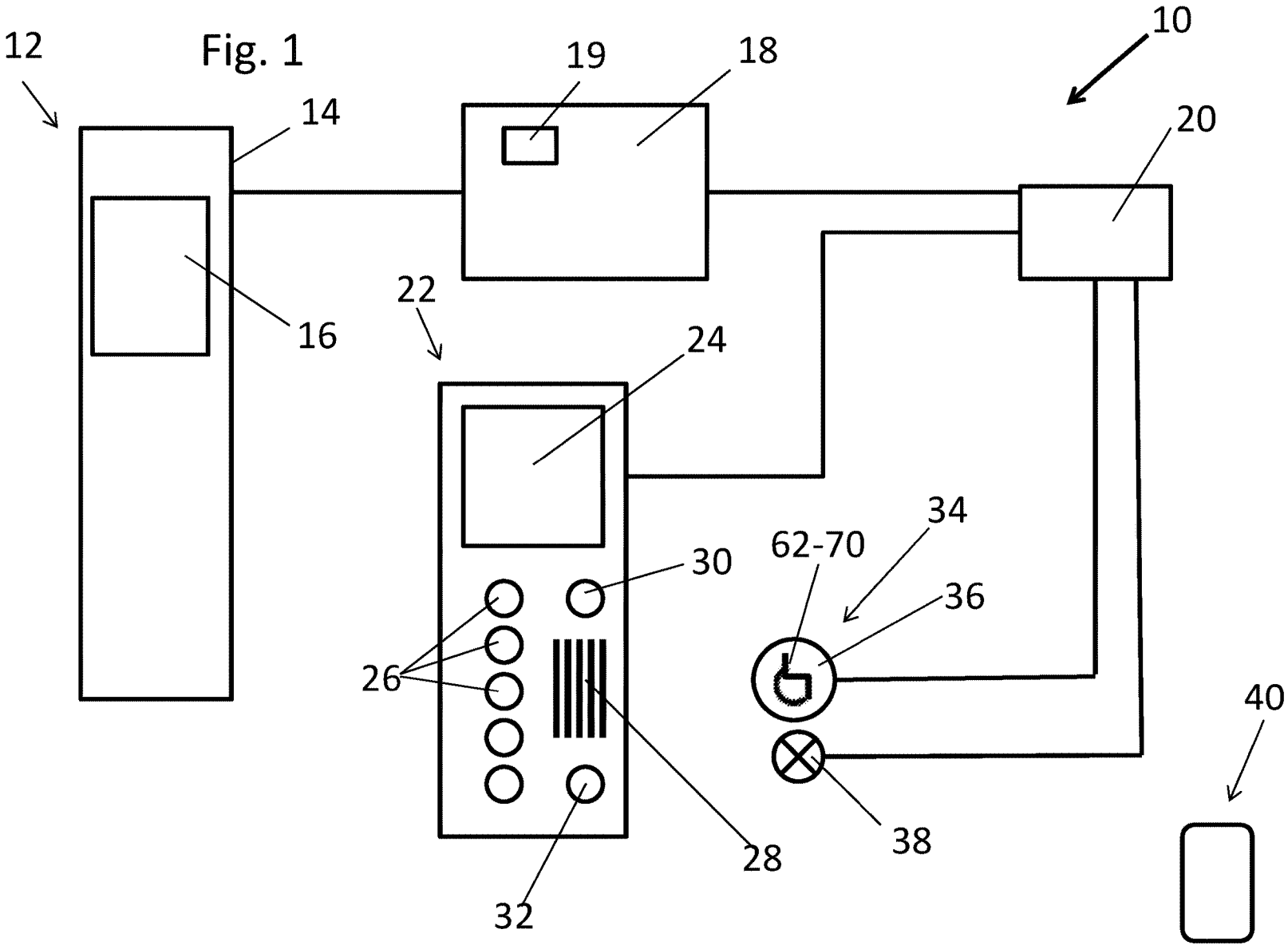
FIG. 1 shows a schematic diagram of an inventive elevator system.

FIG. 1 shows an elevator system 10 comprising at least two elevators 12 each comprising an elevator shaft 14 in which an elevator car 16 is moving vertically. The elevator 12 is of course designed according to current regulations with several safety-related components as a drive unit, hoisting ropes, guide rails, eventually a counterweight, car doors and landing doors which are not shown in the figure. Preferably, the elevator is a traction sheave elevator, preferably a machine-room less traction sheave elevator. All elevators 12 are controlled via an elevator control 18 which is in this case an elevator group control. The elevator group control 18 comprises a memory 19 and has or is connected with an allocation control 20 which realizes all control functions with respect to the elevator call allocation in the elevator system. The allocation control 20 is connected with at least one destination operation panel 22 provided in the lobby of each floor of the elevator system 10. The destination operation panel, short DOP, comprises a display 24, destination call push buttons 26 for selecting different destination floors of the elevator system. The destination call buttons 26 can also be embodied as a decade keyboard. Furthermore, the DOP comprises a loudspeaker 28, an emergency button 30 and optionally at least one door button 32 for faster opening or closing of the car doors and landing doors. Furthermore, the allocation control 20 is connected with a transmitter device 34 which is located behind a tag 36 mounted at the wall or floor of the building in the area of the elevator lobby and/or in the elevator car. The lines in the drawing symbolize electric data and/or control lines between the corresponding components. Behind the tag 36, an illumination device 38 is located to illuminate the tag 36 in response to a special transportation service request. Furthermore, the elevator system 10 comprises ID devices 40 carried by passengers, which ID devices are for example smartphones or RFIDs or any other mobile devices which are able to get into a broadcast contact with the transmitter device 34.

The invention works as follows:

When the ID device 40 gets within a certain range of the transmitter device 34, the ID device 40 is initiated to send data to the transmitter device 34 which data comprise either simply ID data and/or data relating to a special service request and call data as for example the departure floor and the destination floor. With the receipt of the data from the ID device 34, the allocation control 20 controls the illumination device 38 to illuminate the tag 36 covering the transmitter device 34. Via this measure, the passenger acknowledges his special transportation service request being confirmed. Now the allocation control 20 allocates an elevator 12 and displays the number of the elevator on the display 24 of the DOP 22. Furthermore, the allocation control 20 may also indicate the allocated elevator acoustically via the loudspeaker 28 so that the passenger gets visual as well as audio information about his allocated elevator. The activation of audio indication may also be dependent on the type of specialize transportation service requested. As mentioned above, the elevator control 18 comprises a memory 19 for different operating parameters of the elevators 12. For the required special transportation service request, a corresponding set of operating parameters is read from the memory 19 and the elevator control sets the allocated elevator 12 to these particular operating parameters correlated with the required special transportation service. With the data transmitted from the ID device 40 to the transmitter device 34, the allocation control 20 also gets the departure floor and the destination floor of the requested call. Of course, in a preferred embodiment of the invention it is possible to select a different destination floor on the ID device 40. The particular operating parameters may for example relate to other transportation speed or acceleration, to different car sizes, to different load status of the elevator car. Thus, a special transportation service request given by an ID device 40 for a wheelchaired person is only allocated to an elevator car 16 having a low load status so that the interior of the car is presumably empty enough to accommodate the wheelchaired person. The operating parameters are of course also the allocation parameters of an allocation control algorithm of the allocation control 20, as e.g. riding time, waiting time etc.

FIG. 2 shows the details of the transmitter device 34 and the tag 36. The transmitter device 34 comprises a housing 50 which is inserted in a wall 52 of the building and/or elevator car 16. In the housing 50, a transmitter device accommodation space 54 is provided in which a transmitter circuit 56 as well as the illumination device 38 is located. The tag 36 is covering the housing 50 to the public and comprises an LCD display 58 which is controlled by the allocation control 20. The LCD 58 display is optionally surrounded by a metal ring frame 60. The allocation control 20 is able to control the LCD display 58 to display various symbols 62, 64, 66, 68, 70 which are indicative for different special transportation services. Thus, the symbol 62 regards to a first aid service which is for example used by medicines or nurses. The symbol 64 is for an emergency ride which is for example necessary for maintenance persons, police or firefighter to get a priorized elevator ride. The symbol 66 is indicative of a wheelchaired person request whereas the symbol 68 is indicative of a blind person transportation request. At last the symbol 70 indicates a VIP transportation service which has a higher priority than other services. Of course, other special transportation services may be possible which are not listed in FIG. 4.

It shall be clear that the transmitter device 34 with the tag 36 can be located in the elevator lobby as well as in the elevator car whereby it may be located on the floor as well as/or on a wall thereof.

The embodiment of the drawing is not limiting the invention but the invention can be varied within the scope of the appended patent claims.

LIST OF REFERENCE NUMBERS

10 Elevator system
12 Elevator
14 Elevator car
16 Elevator shaft
18 Elevator control
19 Memory
20 Allocation control
22 Destination operation panel (DOP)
24 Display
26 call push buttons
28 Loudspeaker (audio device)
30 Emergency button
32 Door button
34 Transmitter device
36 Tag
38 Illumination device
40 ID device (Smartphone)
50 Housing of Transmitter device
52 Wall of elevator shaft and/or elevator car
54 Transmitter device accommodation space
56 Transmitter circuit
58 LCD-Display
60 Surrounding frame
62 First aid symbol
64 Emergency symbol
66 Wheelchaired person symbol
68 Blind person symbol
70 VIP symbol

The invention claimed is:

1. Arrangement for the allocation of destination calls in an elevator system with at least two elevators, an allocation control device, and at least one destination operation panel, each of the at least one destination operation panels being provided at a respective floor of the elevator system, comprising:

a wireless transmitter device connected with the allocation control device of the elevator system, which transmitter device interacts within a certain mutual distance with a wireless ID device carried by a passenger, which ID device is configured to transmit to the wireless transmitter device an ID which is linked with a special transportation service in the elevator system, whereby the ID device is configured to transmit ID data and/or a call with a departure floor and destination floor to the allocation control device, in which arrangement the wireless transmitter device is separate from the allocation control device and any destination operation panel provided at a respective floor of the elevator system, and located within a predefined distance of an elevator and within a transmitter accommodation space which is physically covered by a tag carrying a symbol correlated to the special transportation service, wherein the elevator system comprises a memory with particular operation parameters of the elevators linked to a special transportation service request of the ID device and that the tag is realized as a display which is configured to display different symbols, each symbol indicative of a different special transportation service, in response to the data received from the ID device.

2. Arrangement according to claim 1, which tag is made of a material permeable for broadcast signals emitted from the wireless transmitter device and the ID device.

3. Arrangement according to claim 1, wherein at least a part of the tag is illuminated by an illumination device and that the illumination device is operable by the elevator system when the wireless transmitter device receives data from the ID device and/or a call is allocated in response to the interaction between the wireless transmitter device and the ID device.

4. Arrangement according to claim 1, further comprising an audio device located within a predefined area around the tag, which audio device is operable by the allocation control device when the wireless transmitter device receives data from the ID device and/or a call is allocated in response to the interaction between the wireless transmitter device and the ID device.

5. Arrangement according to claim 1, wherein the ID device is a smartphone on which an App is running, whereby a default transmission data of the ID device is correlated with a predetermined departure and destination floor.

6. Arrangement according to claim 1, wherein the ID device is a smartphone on which an App is running, which smartphone allows the input of a destination floor, which is transmitted together with a predetermined or actual departure floor to the wireless transmitter device.

7. Arrangement according to claim 1, wherein the symbol comprises at least one visual element and/or at least one three-dimensional touchable element.

8. Elevator system comprising:

at least two cars;

at least one destination operation panel, each of the at least one destination operation panels being provided at a respective floor of the elevator system;

at least one arrangement for the allocation of destination calls in the elevator system; and a wireless transmitter device connected with an allocation control device of the elevator system, which transmitter device interacts within a certain mutual distance with a wireless ID device carried by a passenger, which ID device is configured to transmit to the wireless transmitter device an ID which is linked with a special transportation service in the elevator system, whereby the ID device is configured to transmit ID data and/or a call with a departure floor and destination floor to the allocation control device, in which arrangement the wireless transmitter device is separate from the allocation control device and any destination operation panel provided at a respective floor of the elevator system, and located within a predefined distance of the elevator and within a transmitter accommodation space which is physically covered by a tag carrying a symbol correlated to the special transportation service, wherein the elevator system comprises a memory with particular operation parameters of the elevators linked to a special transportation service request of the ID device and that the tag is realized as a display which is configured to display different symbols, each symbol indicative of a different special transportation service, in response to the data received from the ID device.

9. Elevator system according to claim 8, wherein the allocation control device or an elevator control of the elevator system changes the operation parameters of an elevator allocated to a call entered via the interaction between the ID device and the wireless transmitter device.

10. Elevator system according to claim 9, wherein the operation parameters comprise at least one of the following parameters:

door opening time
door velocity
car acceleration car speed
car size
car load status
addition of voice indication
time span between allocation of an elevator car and arrival of said car,
allocation parameter of the allocation control device.

11. Elevator system according to claim 8, wherein the allocation control device comprises an indication device for an allocated elevator.

12. Elevator system according to claim 11, wherein the indication device is a smartphone.

13. Elevator system according to claim 11, wherein the elevator system includes a plurality of elevator floors and a tag is located at each elevator floor and the indication device is arranged in connection with each tag.

14. Method for allocating destination calls wirelessly in an elevator system in connection with a special transportation service of an elevator, the elevator system comprising as at least two cars, an allocation control device, at least one destination operation panel, each of the at least one destination operation panels being provided at a respective floor of the elevator system, and a wireless transmitter device in communication with but separate from the allocation control device, the method comprising:

receiving by the wireless transmitter device an interaction via a wireless ID device; and issuing a call requiring a special transportation service response to the wireless interaction via the wireless ID device and the wireless transmitter device, whereby the wireless transmitter device is separate from the allocation control device and any destination operation panel provided at a respective floor of the elevator system, and located within a transmitter accommodation space which is physically covered by a tag carrying a symbol indicative of the special transportation service, displaying, in response to the data received from the ID device, a symbol indicative of the special transportation service required by the issued call on the tag, wherein the tag is used as an indication device for an allocated elevator.

15. Method according to claim 14, wherein the wireless transmitter device interacts within a certain mutual distance with the wireless ID device carried by a passenger, which wireless ID device is configured to transmit to the wireless transmitter device an ID which is linked with a special transportation service in the elevator system, the ID device is configured to transmit ID data and/or a call with a departure floor and destination floor to the allocation control device, in which arrangement the wireless transmitter device is located within a predefined distance from an elevator, and the elevator system comprises a memory with particular operation parameters of the elevators linked to a special transportation service request of the ID device and that the tag is realized as a display which is configured to display different symbols according to different special transportation services in response to the data received from the ID device.

16. Arrangement according to claim 2, wherein at least a part of the tag is illuminated by an illumination device and that the illumination device is operable by the elevator system when the wireless transmitter device receives data from the ID device and/or a call is allocated in response to the interaction between the wireless transmitter device and the ID device.

17. Arrangement according to claim 2, further comprising an audio device located within a predefined area around the tag, which audio device is operable by the allocation control device when the wireless transmitter device receives data from the ID device and/or a call is allocated in response to the interaction between the wireless transmitter device and the ID device.

* * * * *